United States Patent [19]

Heimerich

[11] Patent Number: 4,537,361

[45] Date of Patent: Aug. 27, 1985

[54] APPARATUS FOR BREAKING GLASS BOTTLES AND CRUSHING CANS AND LIKE CONTAINERS

[75] Inventor: Henry R. Heimerich, Lynbrook, N.Y.

[73] Assignee: Boro Recycling Center, Inc., Brooklyn, N.Y.

[21] Appl. No.: 529,159

[22] Filed: Sep. 2, 1983

[51] Int. Cl.[3] ..... B02C 19/14

[52] U.S. Cl. ..... 241/81; 241/99; 241/138; 241/DIG. 38

[58] Field of Search ..... 241/101.7, 81, 99, 135, 241/138, 154, 19, DIG. 38

[56] References Cited

U.S. PATENT DOCUMENTS 2,344,591 3/1944 Bried ..... 241/81
3,055,597 9/1962 Muno ..... 241/81 X
4,093,126 6/1978 Castiaux ..... 241/99 X
4,098,181 7/1978 Schultz ..... 241/99 X

*Primary Examiner*—Mark Rosenbaum
*Attorney, Agent, or Firm*—George J. Brandt, Jr.

[57] ABSTRACT

Apparatus for breaking glass bottles and for crushing or deforming metallic cans and P.E.T. containers includes a glass bottle disintegrating means and separate can and P.E.T. container crushing means. A common entry chute to the apparatus allows for random introduction of containers to the apparatus but during the delivery travel of a container to the respective disintegrating or crushing means, an air flow sweeping across the container delivery course diverts lighter weight metallic cans and P.E.T. containers to the appropriate crushing means, whereas, heavier weight glass bottles are unaffected by the air flow and pass into the glass bottle disintegrating means.

13 Claims, 5 Drawing Figures

APPARATUS FOR BREAKING GLASS BOTTLES AND CRUSHING CANS AND LIKE CONTAINERS

BACKGROUND OF THE INVENTION

Containers for soft drinks, beer and like beverages currently are being made as glass bottles, plated steel or aluminum cans and polyethylene terephthalate (P.E.T.) bottles. Because of the undesirable impact careless discarding of such types of used containers can have on our environment, much effort and money has been spent in educating the public to exercise good judgment in disposing of these used containers, preferably by way of delivering them to redemption centers where the user can obtain payment for containers having recycle value, e.g., aluminum cans and glass containers. Public response to such effort has not resulted in any meaningful results in terms of lessening the problem presented by uncaring disposal of these types of beverage containers. In consequence, many state and local legislatures have enacted legislation requiring that beverages when sold include a container deposit charged to the purchaser and requiring for redemption, and hence refund of the deposit, that the purchaser return the empty or used container to the center where purchased or other authorized redemption location. In this way, it is expected that the public will be more responsive and cooperative in effecting proper and ecologically sound disposition of these types of containers with commensurate reduction of the blight improper disposal of these containers has presented in the past.

Corollary to this is the problem such mandated practice will present to the neighborhood beverage dealer, supermarket operator and the like who will in many instances be responsible for effecting redemption and ultimate delivery of redeemed containers to recycle sources or approved waste collection operators. The beverage dealer or supermarket operator will have to "cancel" the redeemed or used container by either disintegrating or otherwise deforming it to convenient smaller size to (a) insure that it can not be redeemed again; and (b) is reduced to form suited for handling economically in the overall disposal process. To carry out such operation almost all beverage sales outlets will have to employ a machine or container destroying unit of some type. In this respect various types and constructions of bottle breakers and can crushers are known. However, such types of these machines as are known are not particularly suited for use at local sales outlets because they are either too expensive, do not allow for selective collection and destruction of say glass bottles on the one hand, and metallic containers and P.E.T. bottles on the other hand, or are unnecessarily too large and complicated for use in the type of wide spread redemption practice contemplated.

SUMMARY OF THE PRESENT INVENTION

An object of the present invention is to provide apparatus for disintegrating glass bottles and for crushing or otherwise permanently deforming metallic cans and P.E.T. containers, the disintegration and crushing operations being carried out in respective separate disintegrating and crushing means, but the access to the apparatus being through a common delivery chute through which containers are introduced without regard to their type.

Another object of the invention is to provide apparatus in which lighter weight metallic cans and P.E.T. containers are diverted from their introduced delivery course by means within the apparatus to insure their delivery to the associated crushing means, while at the same time such means is ineffective to divert a glass bottle from the introduced delivery course which is in line with the glass disintegrating means.

Still another object is to provide such type of apparatus as is compact in size and readily adaptable for use in a wide variety of sales and container redemption location centers.

Art related to the present invention includes U.S. Pat. Nos. 3,489,354; 3,776,128; 3,504,621; 3,827,351; 3,587,984; 3,889,886; 3,655,138; 3,907,087; 3,687,062; 4,226,377 3,756,520; 4,373,435.

The apparatus of the present invention includes a housing mounted on suitable framing and the framing can be fitted with casters to make the apparatus readily transportable on and about the floor or like space of a redemption location. Disposed within the housing are spearate, side-by-side arranged glass container disintegrating means and metallic can and P.E.T. crushing means each being in a particularly convenient form provided as one or more rotary impeller means intended to be operated at speeds designed on the one hand to disintegrate used glass bottles, and on the other hand to effect permanent deformation, crushing or sufficient compaction of used metallic cans and P.E.T. containers as to render them into form as precludes any further use or redemption of same. The housing also includes an entry chute by means of which the used containers are introduced into the housing in random order, i.e., without regard to their type, with the chute having a course directed such as to provide a gravity induced container travel course in line with the glass container disintegrating means, the said course being further defined by an extension piece of suitable shape extending interiorly of the housing and having a lower end disposed over the glass container disintegrating means. The configuration of the extension piece is such as to allow it to gird only a minor portion of the circumferential periphery of a container sliding endwise therealong.

Since there is a common container entry chute, but the glass containers are intended to be disintegrated by means different than that employed for crushing metallic cans and P.E.T. containers, diverter means is provided within the housing to effect diversion of metallic cans and P.E.T. containers from the defined travel course so as to cause them to be delivered to the associated crushing means rather than to the glass disintegrating means. To effect such diversion of metallic cans and P.E.T. containers from the extension piece and cause their delivery onto a diverted container reception chute aligned with the metallic and plastic container crushing means, utilization is made of the fact that for given container sizes, glass containers are heavier than either metallic cans or P.E.T. and like plastic material containers. Thus an air flow generator is diposed adjacent the extension piece and discharges a flow of air in a diverting stream across the container travel course and in quantity and velocity such as to displace any metallic can or P.E.T. container traveling endwise on the extension piece and cause it to pass over onto the diverted container reception chute. However, the magnitude of air flow is not sufficient to cause diversion of heavier glass containers from the extension piece and these articles continue travel on the extension peice and into the glass disintegrating means.

Suitable collection hoppers can be positioned below the glass disintegrating means and the metallic container and P.E.T. crushing means to collect the residue of containers handled by the respective disintegrating and crushing means.

In particularly advantageous forms the rotary impellers of the glass container disintegrating and the metallic can and P.E.T. crushing means are provided as plural vane e.g., four-bladed components and suitable power or drive mean is associated with each. Because the glass container disintegrating means is intended to operate at relatively high speed, the impact effect of a glass container striking a single one only of a rotary impeller is sufficient to cause destructive fragmentation of the glass container into suitably sized pieces for further glass recyle or economic densified packaging for permanent disposal of same. The metallic can and P.E.T. container crushing means is on the other hand preferably provided in the form of a pair of spaced apart rotary impellers one disposed above the other, with the upper impeller having a larger diameter than the lower one. This arrangement was found particulary suitable for effecting permanent deformation of P.E.T. containers and countering the memory properties of P.E.T. to insure that the original shape of a P.E.T. container is permanently distorted by passage through the crushing means.

In an actual embodiment of the apparatus, the rotary impeller units were of such size and operated at speeds such as to provide in the glass disintegrating means an impeller tip speed of about 2500 FPM, and in the metallic can and P.E.T. container crushing means a tip speed of about 50–70 FPM for the upper impeller unit and a tip speed of about 30–50 FPM for the lower impeller unit.

The advantages and further features of the invention will be made more apparent from the following detailed description to be given hereinafter and will be described in terms of such features of construction, combination of elements and arrangements of parts as will be exemplified in the construction set forth and the scope of the invention will be indicated in the claim.

BRIEF DESCRIPTION OF THE DRAWINGS

A fuller understanding of the nature and objects of the invention will be had from the following detailed description taken in conjunction with the accompanying drawings in which.

Throughout the following description, like reference numerals are used to devote like parts in the drawings.

DESCRIPTION OF THE PREFERRED EMBODIMENTS

Figure 3:
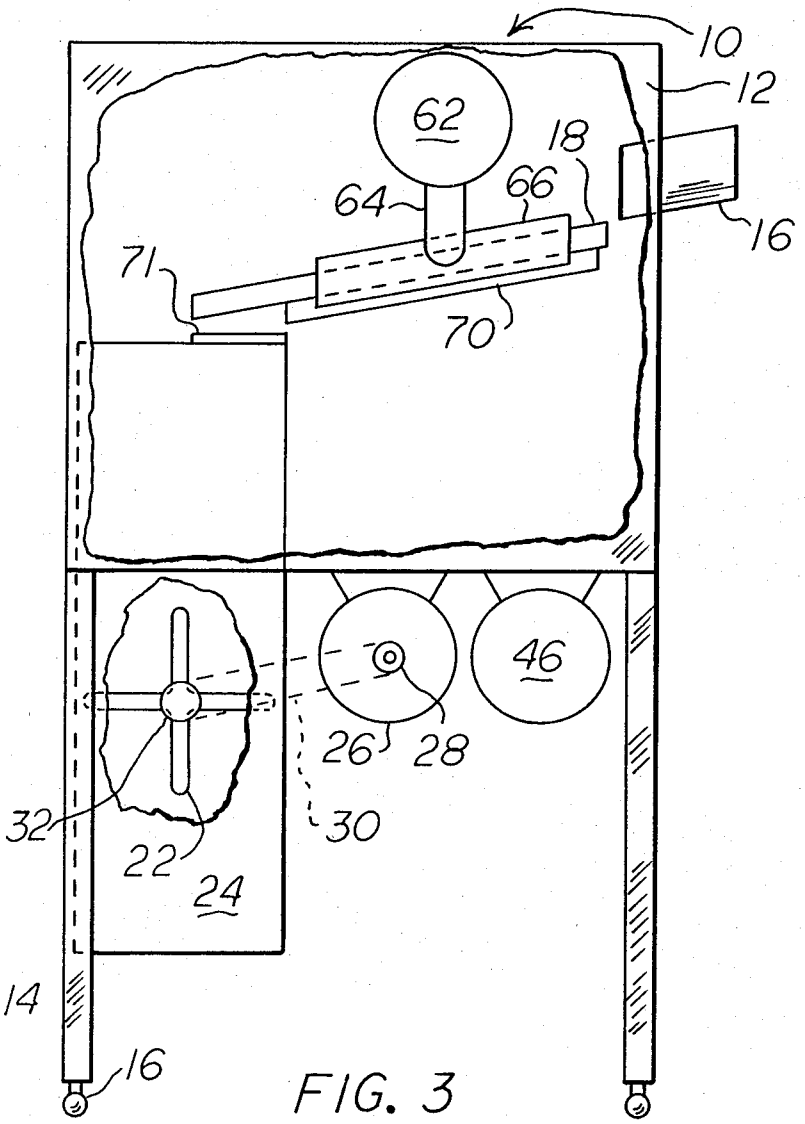
FIG. 3 is a rear side elevational view with housing and impeller casings portions broken away.
Figure 1:
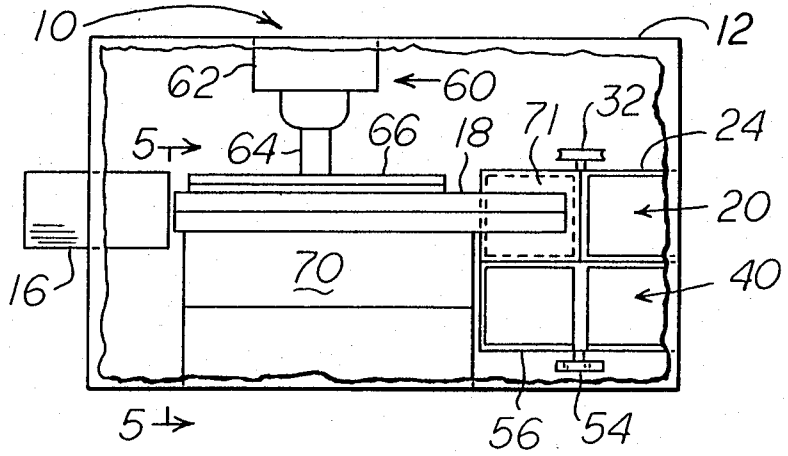
FIG. 1 is a top plan view of the apparatus of the present invention with portions of the housing top broken away for purposes of clarity of depiction of the various constructional details of the apparatus.
Figure 5:
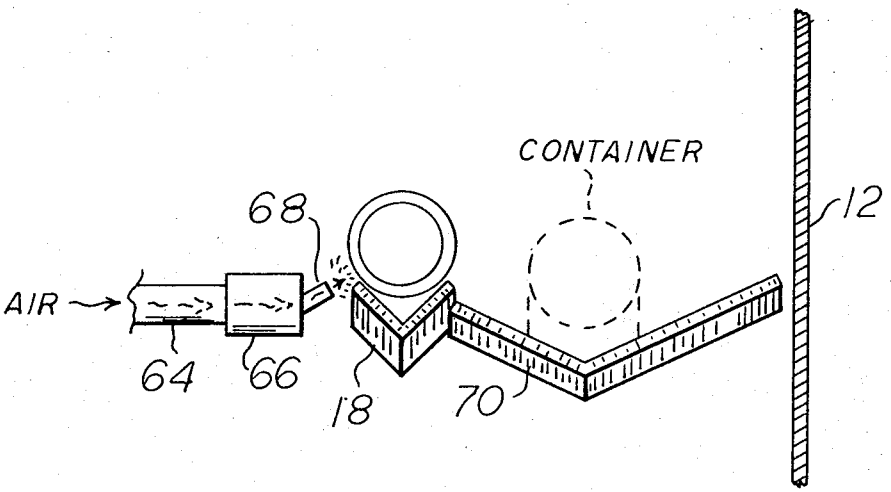
FIG. 5 is a fragmentary elevational view as taken on the line 5—5 in FIG. 1 to illustrate the positioning of the air stream diverter means adjacent the entry chute extension piece and how same functions to divert a metallic can or P.E.T. container to the diverted container reception chute.
Figure 4:
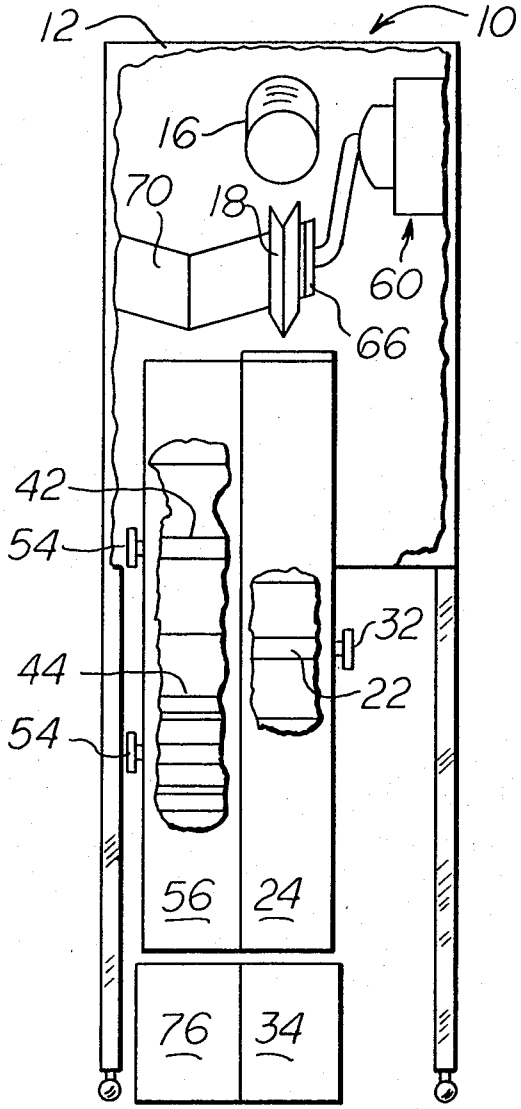
FIG. 4 is a right end elevational view of the apparatus with the housing and casing walls broken away to illustrate the side-by-side arrangement of the respective disintegrating and crushing means.
Figure 2:
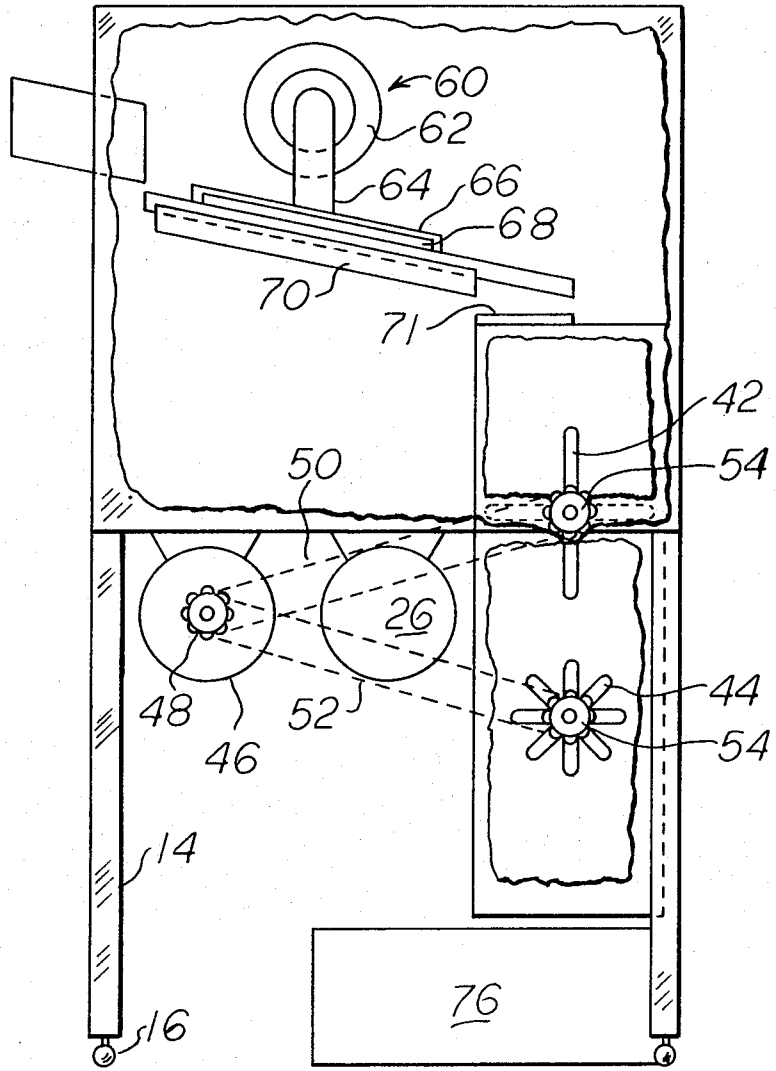
FIG. 2 is a front side elevational view of the apparatus, portions of the housing front wall and the impeller means casings being broken away.

With continuing reference being made to FIGS. 1–4, the apparatus 10 of the present invention includes a housing 12 formed as an enclosure structure supported elevated on suitable framing including legs 14 fitted with casters 16 thereby rendering the apparatus of portable character for ready movement about a container redemption center to any desired location where container disintegration and/or deformation is to be carred out. Carried on one wall of the housing is a container entry chute 16 extending from exterior access or container introduction location interiorly a short distance within the housing. The chute 16 is sized in diameter to readily accept containers of e.g., up to 2 liter P.E.T. bottle size.

Disposed in line with the entry chute 16 is an extension piece 18 formed preferably as an upwardly facing V-shaped section member of some elongate expanse. The chute 16 and extension piece 18 together define a gravity induced container travel course for containers introduced to the housing through chute 16, the received containers traveling such course in sliding endwise travel therealong. The lower end of extension piece 18 it will be noted terminates adjacent and slightly above a glass container disintegrating means 20, such means being provided as a rotary impeller unit having plural vanes 22 and rotable within a casing member 24, the casing 24 being a relatively vertically deep structure and the impeller means 20 being positioned at about mid-height of the casing. By way of representative embodiment, the disintegrating means 20 can be rotated at relatively high speed from drive motor 26, connected from motor sprocket 28 by belt member 30 to a sprocket 32 carried on the shaft of the impeller means 20.

If a glass container, e.g., a quart size bottle or a 12 ounce bottle is introduced into the apparatus, it will slide down chute 16 and extension piece 18, being delivered into the glass container disintegrating means and upon impact of the container with the rapidly rotating vanes 22 be fragmented into relatively small pieces and these will be passed out of the bottom of the casing member 24 into a collector receptacle 34, such receptable being used for glass only.

Since the redemption operation however includes return and "cancelling" of metallic cans and P.E.T. containers in addition to glass containers and since containers can and likely will be randomly introduced into the apparatus, it is necessary to effect proper delivery of metallic cans and P.E.T. containers to a separate crushing means 40 associated with and employed for crushing and otherwise permanently deforming such types of containers. The crushing means 40 includes a pair of impeller units 42, 44 spaced apart vertically a distance with the upper impeller 42 being larger in diameter than the lower one. Drive for these two impeller units can be provided by a motor 46 having a double drive sprocket 48 for respective drive chains 50, 52 connected to the sprockets 54 carried on the shafts of impeller units 42, 44, chains being preferable to belts for this purpose due to the relatively slow speed and high torque requirements of crushing means 40. Crushing means 40 it will be seen is disposed alongside disintegrating means 20 but is laterally offset relative to the container travel course defined by chute 16 and extension piece 18 with such means further being confined in its own relatively deep casing member 56, wherein the two impeller units 42, 44 are disposed in generally the middle third vertical segment of the casing.

To insure proper delivery of a metallic can or P.E.T. container to crushing means 40 rather than to disintegrating means 20, such metallic can or P.E.T. container is following its introduction through chute 16 and during it sliding travel down extension piece 18 diverted from such travel course to direct it into the crushing means 40. For such purpose, advantage is taken of the fact that metallic cans and P.E.T. containers are lighter in weight than glass containers. Thus an air generator unit 60 including a fan 62, delivery line 64 and discharge manifold 66 with an elongated slotted air port 68 is disposed adjacent extension piece 18 to provide an air flow delivery across the container travel course. The manifold can be positioned to direct the air from slightly below the extension piece 18 at an upward angle to facilitate removal of a can or P.E.T. container from the extension piece. The velocity and quantity of such air flow is sufficient to cause lateral displacement of a metallic can or P.E.T. container from the extension piece since the extension piece configuration is such as to gird only a minor portion of the circumferential periphery of the container sliding along piece 18. The container "blown" laterally by the air flow is caused to deposit in the V-section and inclined diverted container reception chute 70, such chute being positioned immediately alongside extension piece 18, being relatively deep, laterally widened to a considerable extent and leading to entry to the crushing means 40. A barrier plate 71 covers a portion of the top of the glass disintegrating means casing 24 thereby substantially eliminating that any accidental carry of a metallic can or P.E.T. container could result in entry of same to the impeller means 20, since the arrangement is such that access to the casing 24 is only possible for a container, i.e., a glass container which has travelled down the direct course defined by the extension piece. A metallic can or P.E.T. delivered to the crushing means 40 strikes upper impeller 42, is subjected to an initial crushing and passes then into impeller 44 which further compacts and deforms the container to a condition rendering it unfit for reuse or redemption. The thus crushed container then passes into a collection receptacle 76 wherein metallic cans and P.E.T. containers are collected for further disposal purposes.

In an actual embodiment of the apparatus the rotary impeller of disintegrating means 20 was provided as a 4-vane component 8 inches in diameter, and the motor unit 26 operated to drive the impeller at a relatively high tip speed of about 2500 FPM. The impellers of the crushing means 40 were provided as a 8/14 inch diameter, 4-vane unit for upper impeller 42, and a 5 inch, 8-vane unit for lower impeller 44 with the motor unit 46 operated to give an upper impeller tip speed of about 50–70 FPM and a lower impeller tip speed of about 30–50 FPM, which speeds it will be noted are relatively slow but found to be significant in effecting permanent deformation of P.E.T. containers and countering the memory property of P.E.T. An 8 vaned lower impeller 44 was employed inasmuch as use of same was found especially effective for permanently deforming P.E.T. bottles on which the cap was present. Capped P.E.T. bottles are particularly resistant to crushing.

The apparatus of the invention it will be noted is a compact, simply operated one, allows for random introduction of the various kinds of beverage containers presently being used but effects classification within the apparatus to destroy and collect only glass containers with one disintegrating means, whereas, light weight metallic cans and P.E.T. containers are handled in a different and separate crushing means.

While there is above disclosed only one embodiment of the apparatus of the present invention, it will be appreciated that various modifications can be made within the scope of the disclosed invention without departing from the scope of the claims.

What is claimed is:

1. Amended apparatus for disintegrating used glass containers and for sufficiently crushing or deforming used metallic and plastic containers to preclude reuse of such types of containers, said apparatus comprising a housing, glass container disintegrating means disposed in said housing, metallic and plastic container crushing means disposed in said housing situate proximate said glass container disintegrating means, entry chute means carried on said housing for introducing containers into said housing, the course of said chute being disposed such as to provide a gravity induced and supported container travel along a predetermined course in line with said glass container disintegrating means, said chute means including an extension piece which girds a portion of the container periphery, and diverter means carried within said housing and operative to divert any metallic and plastic container introduced therein from its travel along said predetermined course and cause it to be delivered to said metallic and plastic container crushing means, said diverter means comprising an air flow generator discharging a flow of air in a container diverting stream across said container course and including an air manifold extending longitudinally of said travel course adjacent thereto, the quantity and velocity of said flow being sufficient to displace metallic and plastic containers from their girded embrace on said extension piece but insufficient to divert a glass container from its travel in said course.

2. The apparatus of claim 1 in which said manifold is disposed relative to said travel course such as to direct air flow thereagainst from a location slightly below said travel course.

3. The apparatus of claim 1 in which said glass container disintegrating means comprises a rotary impeller unit.

4. The apparatus of claim 3 further comprising drive means for rotating said glass container disintegrating impeller unit at a relatively high speed.

5. The apparatus of claim 4 in which said drive means rotates said glass container disintegrating impeller at an impeller tip speed of about 2500 FPM.

6. The apparatus of claim 1 in which said metallic and plastic container crushing means comprises a pair of impeller, units arranged one spaced above the other.

7. The apparatus of claim 6 further comprising a drive unit for rotating said pair of metallic and plastic container crushing impellers at relatively low speed.

8. The apparatus of claim 7 in which the upper impeller unit has 4 vanes and the lower impeller unit has 8 vanes.

9. The apparatus of claim 7 in which said drive unit rotates said pair of impellers at such speed, and the said pair of impellers so sized that the impeller tip speed of the upper impeller is about 50–70 FPM and the impeller tip speed of the lower impeller is about 35–50 FPM.

10. The apparatus of claim 6 in which both of said impeller units are plural vane type impellers, the lower impeller unit having a greater number of vanes than the upper impeller unit.

11. The apparatus of claim 1 in which said extension piece is interiorly of said housing and has a lower end disposed over said glass container disintegrating means, said extension piece having a configuration such as to gird only a minor position of the circumferential periphery of a container sliding endwise therealong.

12. The apparatus of claim 11 in which said extension piece is a V-section member.

13. The apparatus of claim 11 comprising a diverted container reception chute disposed adjacent said extension peice and aligned with said metallic and plastic container crushing means for receiving metallic and plastic containers diverted from said travel course by said diverter means and directing them into said crushing means.

* * * * *

UNITED STATES PATENT AND TRADEMARK OFFICE

CERTIFICATE OF CORRECTION

PATENT NO. : 4,537,361

DATED : August 27, 1985

INVENTOR(S) : Henry R. Heimerich

It is certified that error appears in the above-identified patent and that said Letters Patent is hereby corrected as shown below:

Column 6, line 13, delete " Amended "
" " , change " apparatus " to --Apparatus--

Signed and Sealed this

*Twenty-sixth* Day of *November 1985*

[SEAL]

*Attest:*

DONALD J. QUIGG

*Attesting Officer*

*Commissioner of Patents and Trademarks*